US006758503B2

(12) United States Patent
Sadler

(10) Patent No.: US 6,758,503 B2
(45) Date of Patent: Jul. 6, 2004

(54) PADDLE LOCK HAVING SLIM PROFILE

(75) Inventor: Dennis Sadler, Irmo, SC (US)

(73) Assignee: Randall C. Hansen, Columbia, SC (US)

( * ) Notice: Subject to any disclaimer, the term of this patent is extended or adjusted under 35 U.S.C. 154(b) by 0 days.

(21) Appl. No.: 10/024,921

(22) Filed: Dec. 19, 2001

(65) Prior Publication Data

US 2003/0111845 A1 Jun. 19, 2003

(51) Int. Cl.[7] ..... E05C 1/06
(52) U.S. Cl. ..... 292/35; 292/DIG. 31
(58) Field of Search ..... 292/35, 34, 336.3, 292/DIG. 31; 70/208

(56) References Cited

U.S. PATENT DOCUMENTS

| | | | | |
|---|---|---|---|---|
| 3,576,118 A | | 4/1971 | Doerrfeld | |
| 3,871,198 A | | 3/1975 | Miller | |
| 4,420,954 A | | 12/1983 | Hieronymi et al. | |
| 4,892,338 A | | 1/1990 | Weinerman et al. | |
| 4,951,486 A | | 8/1990 | Braun et al. | |
| 4,989,907 A | | 2/1991 | Edmonds et al. | |
| 5,439,260 A | | 8/1995 | Weinerman et al. | |
| 5,564,295 A | | 10/1996 | Weinerman et al. | |
| 5,586,458 A | | 12/1996 | Weinerman et al. | |
| 5,586,795 A | * | 12/1996 | Sasaki | 292/336.3 |
| 5,595,076 A | * | 1/1997 | Weinerman | 70/208 |
| 5,875,948 A | | 3/1999 | Sadler | |
| 5,884,948 A | * | 3/1999 | Weinerman | 292/216 |
| 5,941,104 A | * | 8/1999 | Sadler | 70/208 |
| 5,984,383 A | * | 11/1999 | Parikh | 292/121 |

OTHER PUBLICATIONS

Hansen Commercial & Industrial Hardware Catalogue, pp. 9 and 28.

* cited by examiner

*Primary Examiner*—Gary Estremsky
(74) *Attorney, Agent, or Firm*—Dority & Manning, P.A.

(57) ABSTRACT

An offset handle assembly for use on a vehicle or structure comprising a tray that has a front side and back side, which also defines a recess. A handle is pivotal with respect to the tray. The handle is substantially located on the front side of the tray, and within the recess. A mechanical linkage is operatively connected to the handle. The mechanical linkage operates when the handle is turned. Also, an operating mechanism is operatively connected to the mechanical linkage. The operating mechanism is disposed on the back side of the tray and adjacent the recess so as to be laterally offset from the handle. Operation of the mechanical linkage causes the operating mechanism to operate.

20 Claims, 10 Drawing Sheets

PADDLE LOCK HAVING SLIM PROFILE

TECHNICAL FIELD

This invention relates to handles used on vehicles and structures. More particularly this invention relates to a paddle handle assembly that has an offset operating mechanism to effect a slim profile in order to conserve space in or on the object to which the paddle handle assembly is attached.

BACKGROUND

Handle assemblies utilizing paddle handles are well known in industry for use on vehicle doors or compartments. Additionally, paddle handles are commonly used in homes or businesses in a variety of applications. Typically, the paddle handle includes a tray which has a recess. The paddle handle is disposed inside of this tray and is pivotal with respect to this tray. The tray is mounted flush with the surface of the door being latched. This flush mounting provides aerodynamic benefits, and is attractive in style and appearance.

Connected to the paddle handle, in back of the tray, is a linkage or an operating arm which actuates once the paddle handle is rotated by a person or a machine. Such linkages or operating arms are then connected to a cable, rod, or other such mechanism, which in turn is connected to a door latch. Upon actuation of the linkage, the door is unlatched and may be opened. Alternatively, the linkages or operating arms are sometimes themselves equipped with a latch bar which is fit into an opening in a door jamb or contacts another surface. Actuation of the operating arm causes the latch bar to move out of the door jamb or away from the other surface, hence allowing the door to be opened.

Different configurations of operating arms and paddle handles in general are well known in the prior art. Various configurations of operating arms and paddle handles are described in U.S. Pat. Nos. 4,420,954; 4,892,338; and 4,951,486. In addition, another such paddle handle that represents the prior art is a rotary combination compartment lock sold by Hansen International of Columbia, S.C.

While the prior art teaches various configurations of operating arms for paddle handles, the prior art does not teach a way of configuring a paddle handle such that the width of the paddle handle assembly is minimized. The prior art places the operating arm or linkage directly behind the recess formed in the tray. This placement causes the paddle handle assembly to have a significant depth. In applications such as in vehicle doors, space is at a premium, and it may not be possible to fit a paddle handle into a door that is thin or has other components. Therefore, there is a need for an offset handle assembly which has a slim profile thereby minimizing the depth of the paddle handle and allowing the paddle handle to be used in applications which require a paddle handle assembly of small depth.

SUMMARY

Objects and advantages of the invention will be set forth in part in the following description, or may be obvious from the description, or may be learned through practice of the invention.

One aspect of the present invention provides an improved paddle handle assembly having an offset operating mechanism. The paddle handle assembly consists of a tray which has a front side and a back side. The tray also has a recess and a paddle handle is disposed in this recess on the front side of the tray. The paddle handle can be pivoted with respect to the tray. Also, the paddle handle assembly has a base member that extends to the back side of the tray. This base member has a flange on one end. The base flange extends laterally adjacent the recess. Further, a drive member is included in the paddle handle assembly. The drive member has a drive portion that is disposed on the back side of the tray. The drive member is mounted for pivotal movement with the paddle handle. At least one linkage member is operatively connected to the drive member. The linkage member is disposed on the back side of the tray. Also, an operating mechanism is present in the paddle handle assembly. This operating mechanism is secured to the base member flange. The operating mechanism is operatively connected to the linkage member. Pivoting of the paddle handle with respect to the tray causes the drive member and the linkage member to effect operation of the operating mechanism.

Also, according to another aspect of the invention, an offset handle assembly is provided. This assembly has a tray which has both a front side and a back side, and also defines a recess. A handle which is pivotal with respect to the tray is provided. This handle is substantially located within the recess on the front side of the tray. A mechanical linkage is operatively connected to this handle, and the mechanical linkage operates when the handle is turned. An operating mechanism is operatively connected to this mechanical linkage. The operating mechanism is disposed on the back side of the tray and is adjacent to the recess so as to be laterally offset from the handle. Operation of the mechanical linkage causes the operating mechanism to operate.

Optionally, the operating mechanism of the assembly may include a pin and a first operating mechanism member rotatably mounted to the pin. A second operating mechanism member may be rotatably mounted to the pin. The second operating mechanism member is pivotable with respect to the first operating mechanism member. An operating mechanism bolt may extend through the first and second operating mechanism members for pivoting the first operating mechanism member relative to the second operating mechanism member.

Alternatively, the paddle handle assembly may have a first rod that could pivotally connect to one end of the operating mechanism for connection to a first latch. A second rod could pivotally connect to another end of the operating mechanism in order to connect to a second latch.

Another aspect of the present invention may have the linkage member move substantially forward and backward in one direction. The assembly may further include a first rod that is pivotally connected to one end of the operating mechanism. The first rod may move in a direction substantially perpendicular to that of the linkage member. A second rod may be pivotally connected to one end of the operating mechanism. The second rod may move in a direction substantially perpendicular to that of the linkage member.

BRIEF DESCRIPTION OF THE DRAWINGS

A preferred embodiment of the present invention is described by way of example with reference to the accompanying drawings, in which.

DETAILED DESCRIPTION

Figure 1:
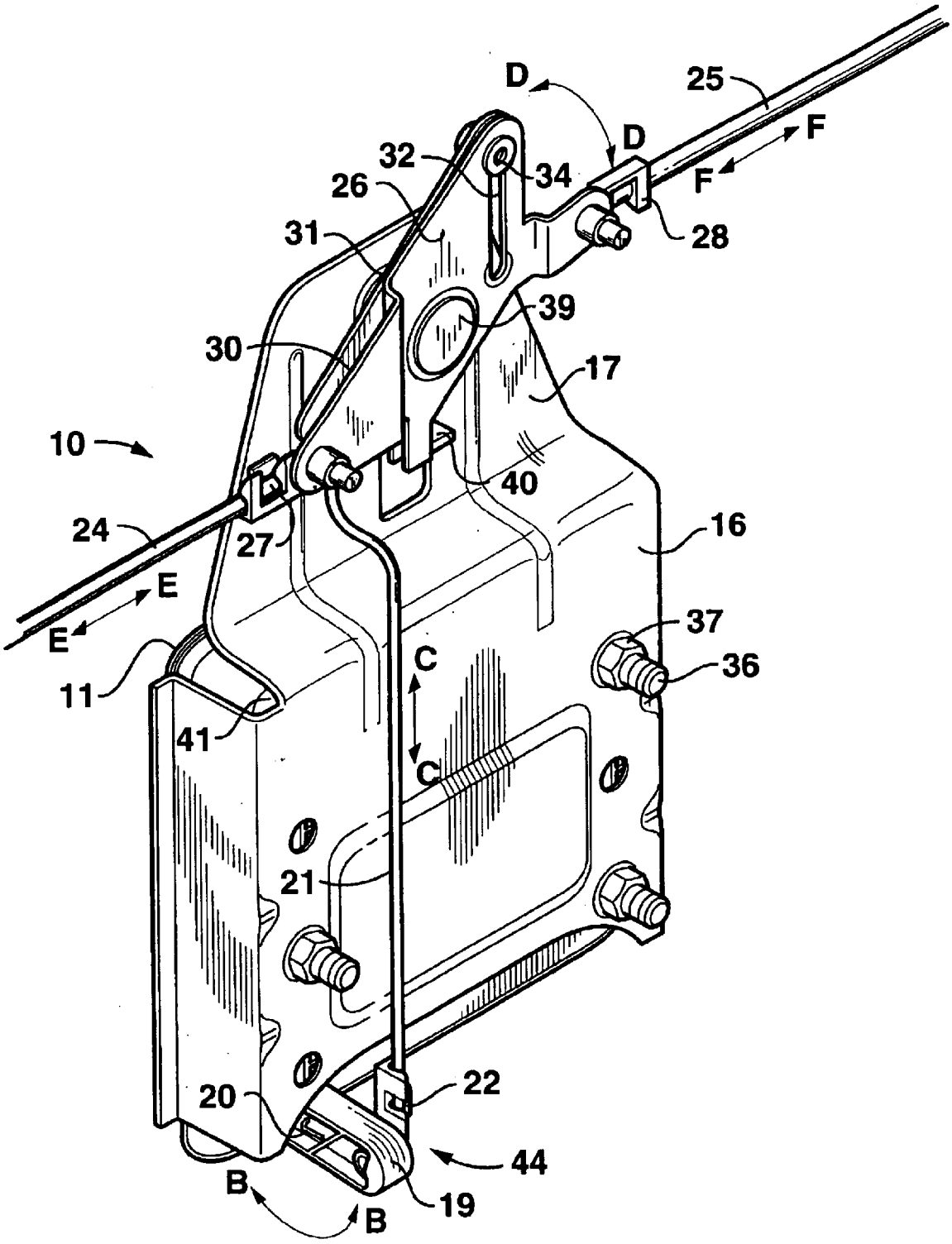
FIG. 1 is a perspective view of the back side of one example of an offset handle assembly embodying certain aspects of the present invention.

Reference will now be made to the presently preferred embodiment of the present invention, an example of which is illustrated in the drawings. The example is provided by way of explanation of the invention and is not meant as a limitation of the invention. For example, features illustrated or described as part of one embodiment can be used on another embodiment to yield yet a third embodiment. Accordingly, it is intended that the present invention include such modifications and variations.

Referring now to the drawings, FIG. 1 shows one example of an offset handle assembly 10 in accordance with certain aspects of the present invention. Offset handle assembly 10 has an operating mechanism 26 laterally offset from a tray 11. Laterally offsetting operating mechanism 26 from tray 11 allows the offset handle assembly 10 to have a slim profile.

Figure 2:
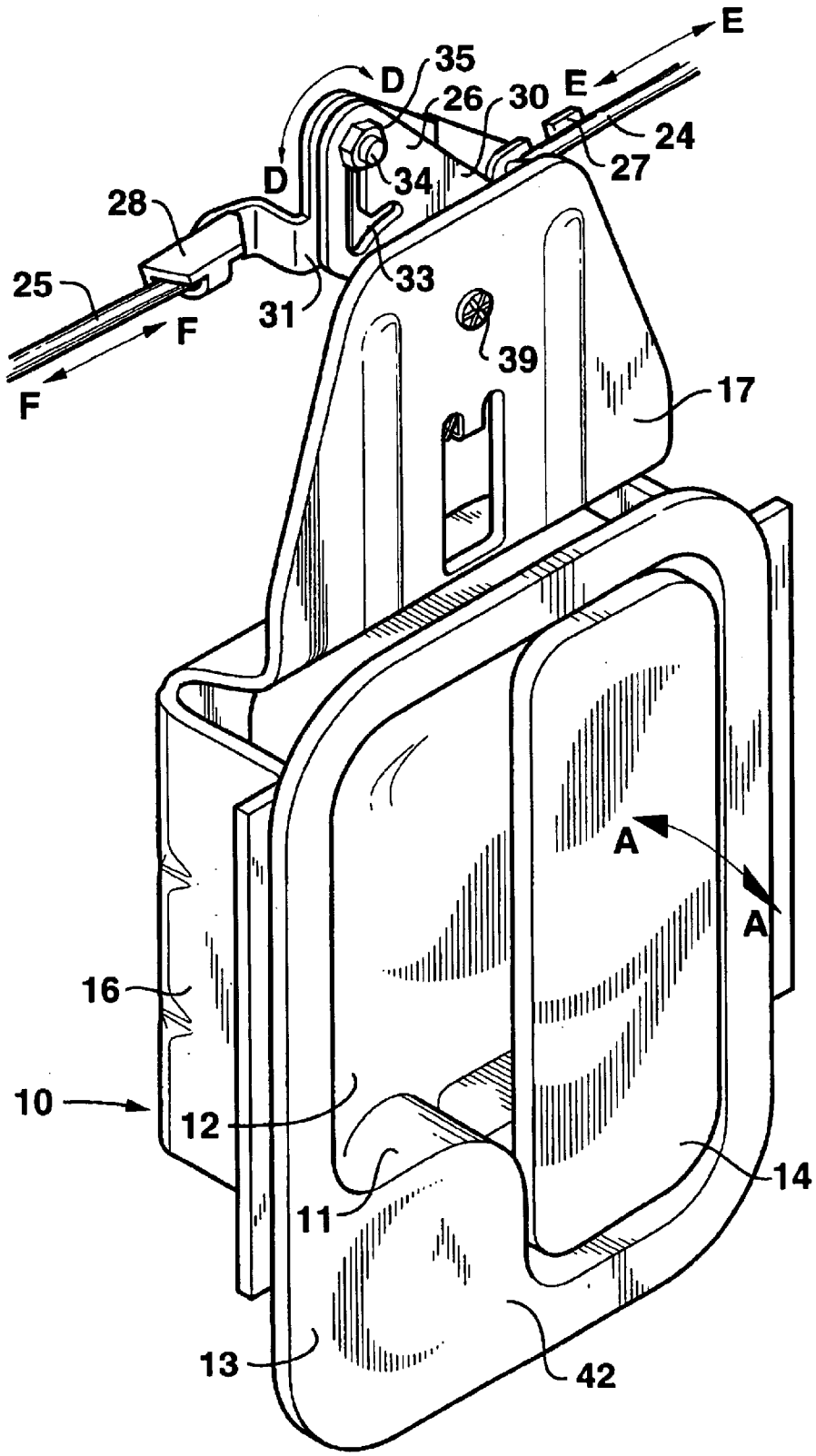
FIG. 2 is a perspective view of the front side of the offset handle assembly of FIG. 1.
Figure 3A:
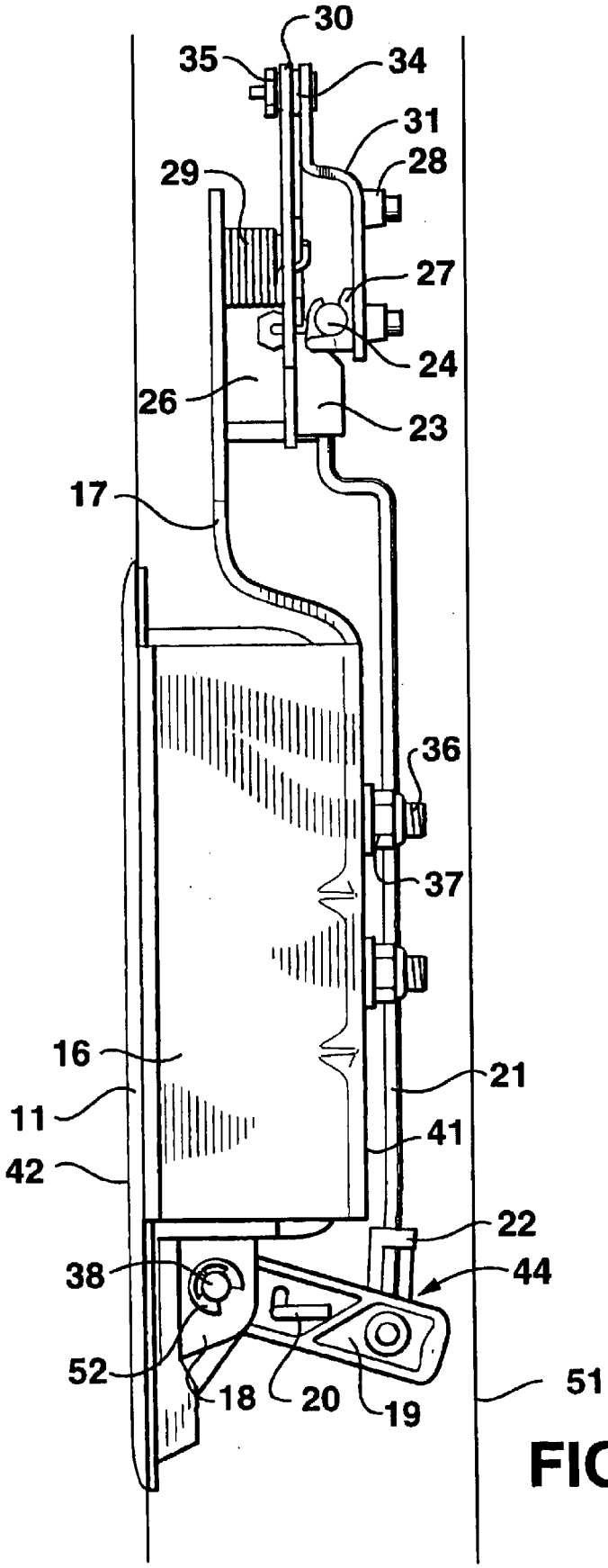
FIG. 3A is a right side elevation view of the offset handle assembly of FIG. 1 showing the paddle handle in an unoperated condition.
Figure 3B:
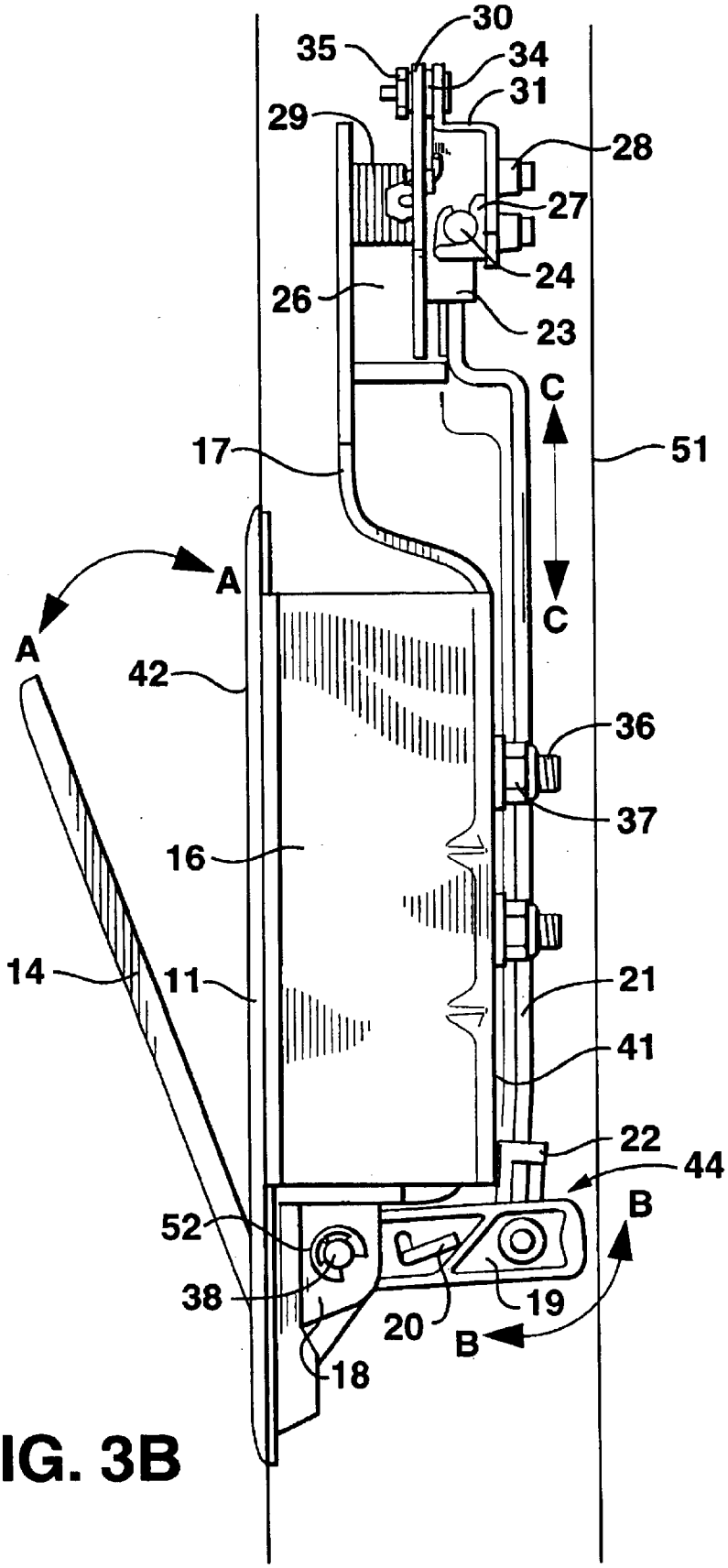
FIG. 3B is a right side elevation view of the offset handle assembly of FIG. 1 showing the paddle handle in an operated position.

FIG. 2 shows a front isometric view of offset handle assembly 10. Tray 11 has a tray flange 13 extending about its perimeter. Tray 11 also has a recess 12 located substantially in the center of tray 11. Recess 12 has a paddle handle 14 disposed therein. Paddle handle 14 is pivotal with respect to tray 11 about a pin 38. Tray 11 has a front side 42 and a back side 41. Offset handle assembly 10 has a base member 16 attached to the back side 41 of tray 11. This attachment is effectuated by tray bolts 36 and tray nuts 37, however, it is to be understood that the attachment of base member 16 to tray 11 can be accomplished by various means known in the prior art such as, pinning, riveting, or welding. Alternately, it is possible that base member 16 be formed integral with tray 11.

As shown, base member 16 has a base flange 17 extending from one end. Preferably base member 16 and base flange 17 are formed from one piece. However, it is also possible to weld or otherwise attach base flange 17 to base member 16.

Pin 38 pivotally connects a drive member 19 to tray 11. A clip 52 engages pin 38. Drive member 19 has a drive portion 43 attached to the back side 41 of tray 11. A first spring 20 is contiguous with drive portion 43 and is also in contact with drive member 19. First spring 20 is an axially mounted coil spring that acts against drive member 19 and urges drive member 19 to the position shown in FIG. 4A. Due to the connection between drive member 19 and paddle handle 14 by pin 38, first spring 20 also acts to keep paddle handle 14 disposed within the recess 12 of tray 11. An appropriate amount of force must be applied to paddle handle 14 to overcome the resistance provided by first spring 20. Additionally, the biasing action of first spring 20 acts to maintain rattle-free engagement between paddle handle 14 and tray 11.

A linkage member 21 is located proximate to base member 16. Linkage member 21 has a first linkage end connection 22 located on one end. The first linkage end connection 22 allows for a pivotal connection between linkage member 21 and drive member 19. The kinematical components such as drive member 19 and linkage member 21 located between handle 14 and operating mechanism 26 are referred to herein generally as mechanical linkage 44.

At the other end of linkage member 21 is the second linkage end connection 23. Second linkage end connection 23 is pivotally connected to operating mechanism 26. Operating mechanism 26 is connected to base flange 17 by the operating arm pin 39. Operating mechanism 26 is free to rotate partially about flange 17 via operating arm pin 39. The operating mechanism 26 is composed primarily of two plates 30 and 31. However, it is to be understood that various configurations of an operating mechanism 26 such as, for example, hooks, rotaries, sliders, etc. are possible, and all are to be included within the scope of the present invention. Use of these two plates 30 and 31 allows the offset handle assembly 10 to be used in either a lockable or an non-lockable configuration. FIGS. 1–4B show a non-lockable configuration and FIGS. 5A–5D shown a lockable configuration.

In the lockable configuration, a lock cylinder 46 having a flange 47 is provided. A flange connection end 50 of lock member 48 pivotally engages flange 47. One way to provide the pivot action would be to shape the flange connection end 50 as a hook extending through a hole in flange 47, although various other configurations are possible. The first operating mechanism member 30 has a first operating mechanism slot 33 roughly in the shape of a "v" located along a portion of its length. The second operating mechanism member 31 has a second operating mechanism slot 32. The two slots 32 and 33 partially overlap one another. A lock member connection 52 is provided on one end of lock member 48. An operating arm bolt 34 extends therefrom and through both slots 32 and 33.

Figure 5A:
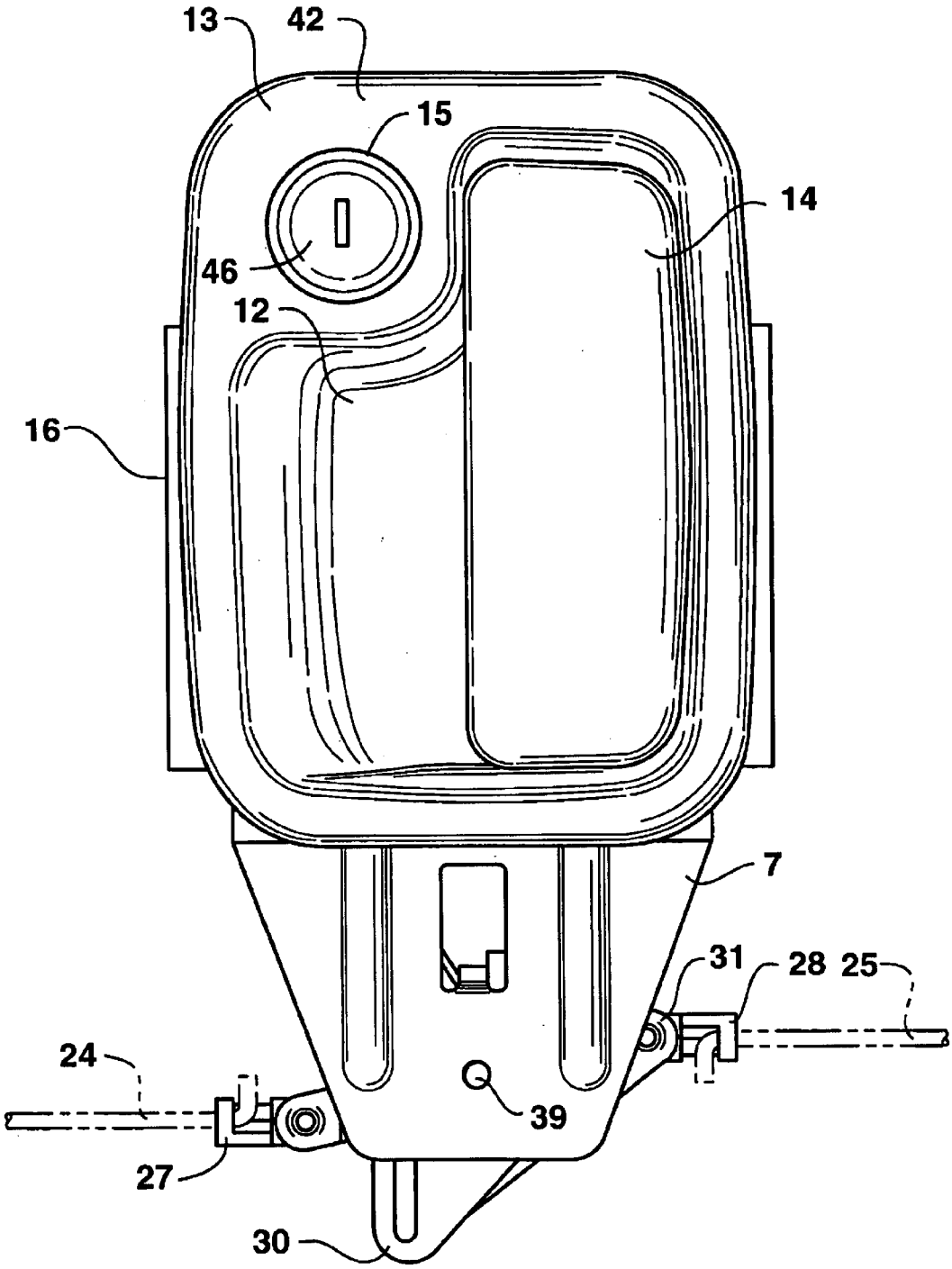
FIG. 5A is a front plan view of one example of an alternative embodiment of an offset handle assembly according to certain aspects of the present invention in an unoperated condition.
Figure 5B:
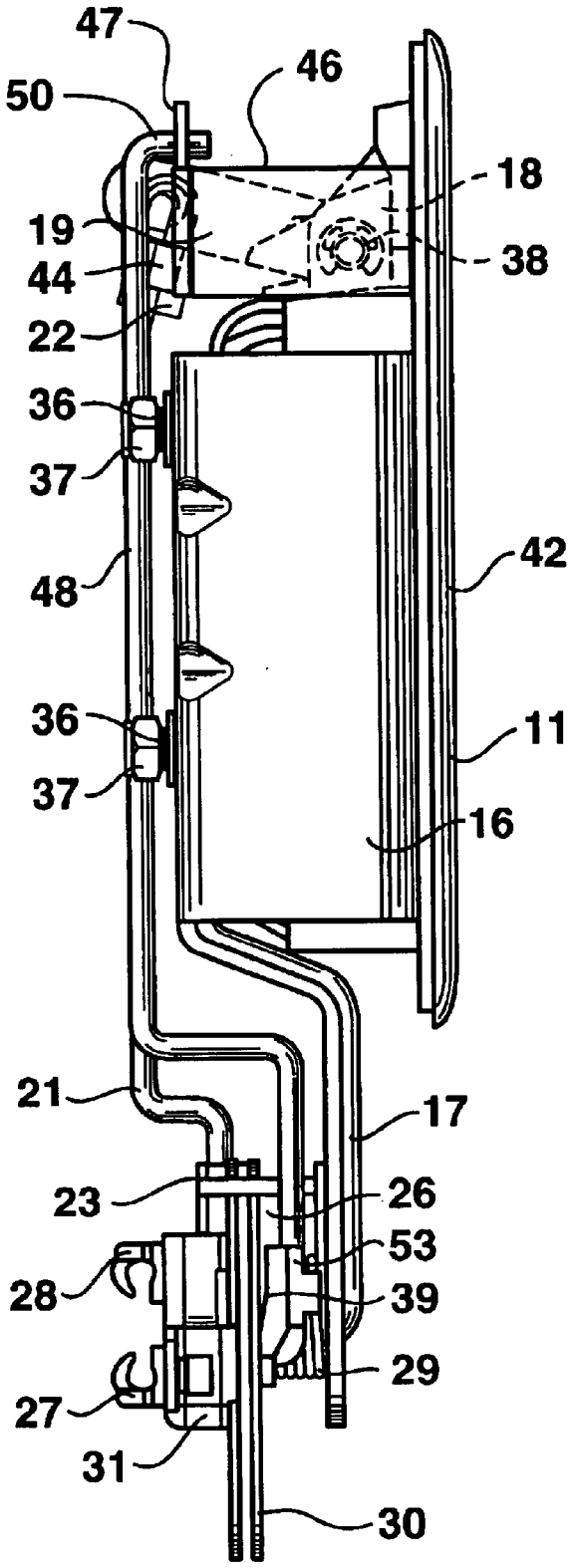
FIG. 5B is a right side elevation view of the offset handle assembly of FIG. 5A in an unoperated condition.
Figure 5C:
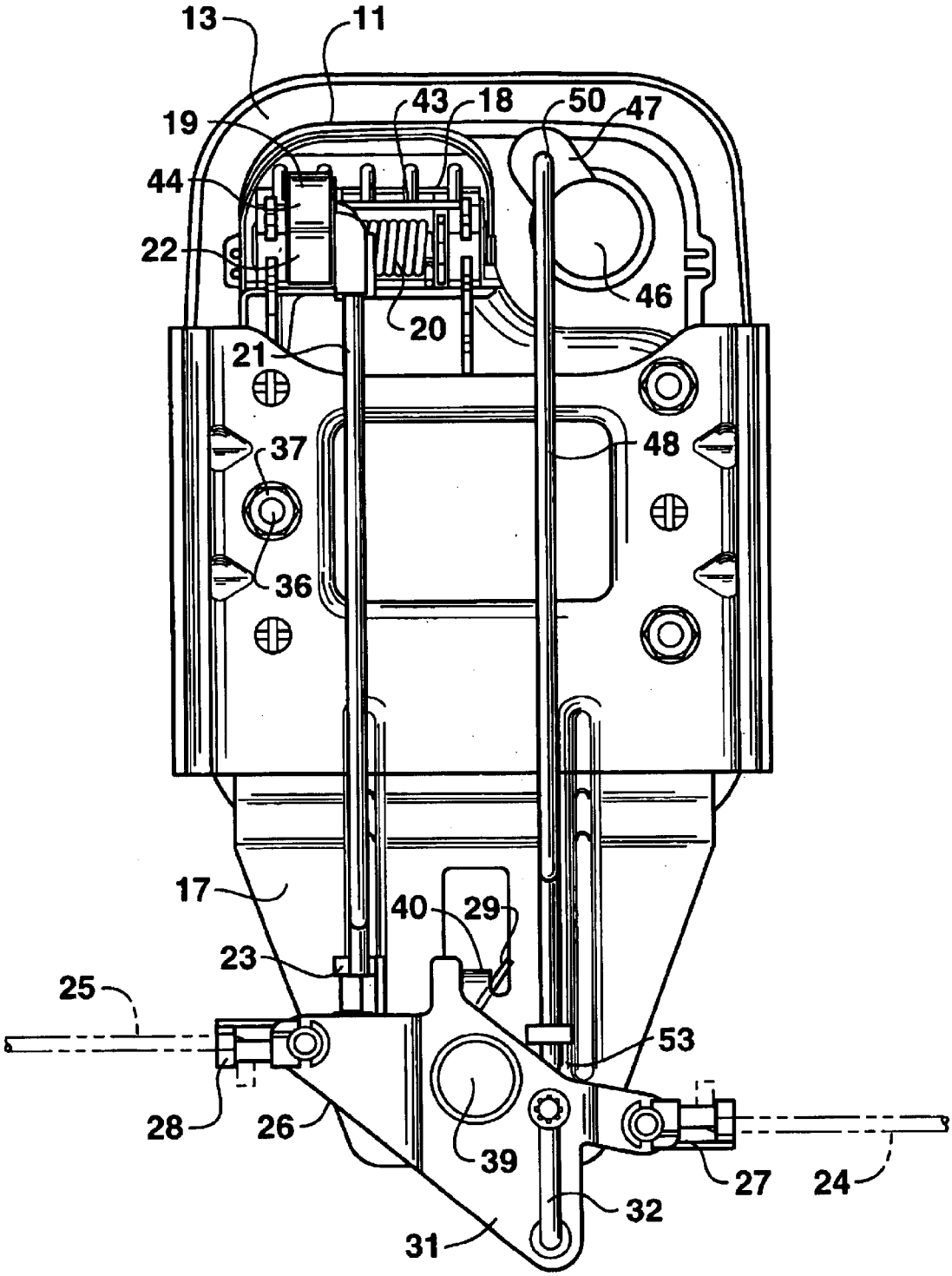
FIG. 5C is a back plan view of the offset handle assembly of FIG. 5A in an unoperated condition.
Figure 5D:
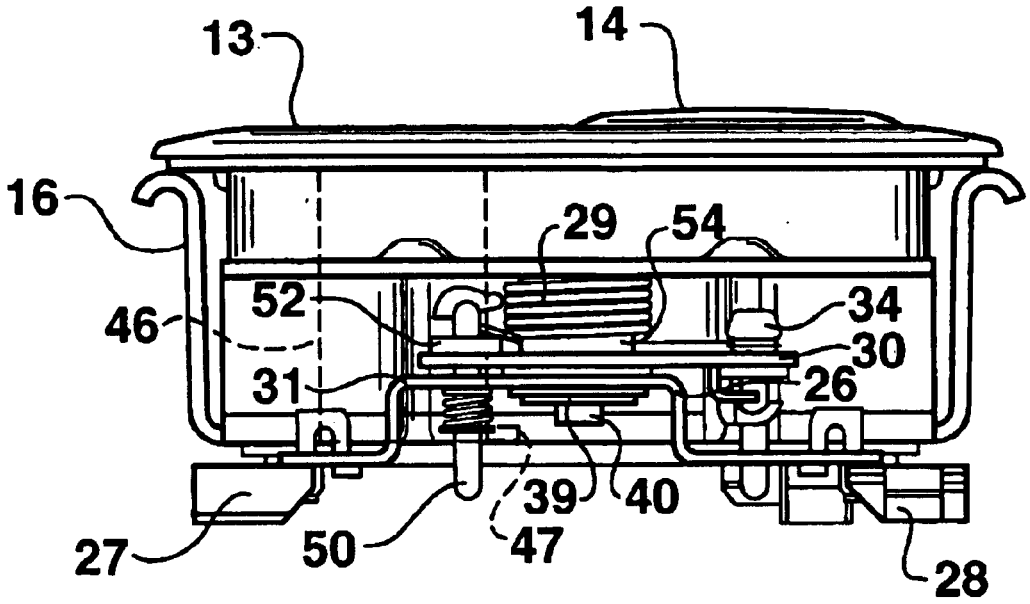
FIG. 5D is a top view of the offset handle assembly of FIG. 5A.

Turning of lock cylinder 46 results in linear movement of operating arm bolt 34. FIG. 5C shows the offset handle assembly 10 in a locked configuration. Actuation of paddle handle 14 results in linkage member 21 urging the first operating mechanism member 30 to rotate. The second operating mechanism member 31 will not rotate, consequently causing the first and second rods 24 and 25 to remain stationary. This is because the operating arm bolt 34 will have the first operating mechanism slot 33 passed around it when the first operating mechanism member 30 rotates. The operating arm bolt 34 will not be urged against the second operating mechanism member 31 and no movement will be imparted to the second operating mechanism member 31.

Turning the lock cylinder 46 so that the operating arm bolt 34 is moved to an opposite end of the second operating mechanism slot 32 from that shown in FIG. 5C results in an unlocked configuration of the handle assembly 10. Rotation of the first operating mechanism member 30 causes the operating arm bolt 34 to be urged against the second operating mechanism member 31, and hence resulting in movement of both the first and second rods 24 and 25.

A nut 35 may be used to fixedly attach the operating mechanism bolt 34 onto the first and second operating mechanism members 30 and 31. FIGS. 1 and 2 show such an embodiment. In this case, the offset handle assembly 10 is in an unlocked configuration.

A second spring 29 is located between base flange 17 and first operating mechanism member 31. Second spring 29 acts to bias the operating mechanism 26 to the position shown in FIG. 4A. Biasing of operating mechanism 26 acts to keep the door 51, shown in FIG. 3B, properly and securely latched, and also ensures that only a proper amount of force applied to paddle handle 14 will rotate operating mechanism 26. Additionally, biasing action by second spring 29 acts to maintain rattle-free engagement between operating mechanism 26 and first rod 24 and second rod 25. Also, rattle-free engagement with base flange 17 is maintained. Base flange 17 has a back base flange tab 40 extending therefrom proximate to operating mechanism 26. Back base flange tab 40 is used to hold second spring 29 against first operating mechanism member 30 and therefore bias operating mechanism 26 to the position shown in FIG. 4A.

Second operating mechanism member 31 has a first cable connection 27 pivotally attached to one end and a second cable connection 28 pivotally attached to an opposite end. First rod 24 is connected on one end to first cable connection 27, and second rod 25 is connected on one end to second cable connection 28. First rod 24 and second rod 25 are attached on opposite ends to latching mechanisms (not shown). Typically, first rod 24 and second rod 25 provide for a flexible connection between the latching mechanisms and operating mechanism 26.

Upon actuation of the offset handle assembly 10, these two latching mechanisms will actuate and cause an opening of the door that is being latched. Turning of paddle handle 14 results in paddle handle 14 being moved from the position shown in FIG. 2 to the position shown in FIG. 3B. This movement is indicated as arrow A—A. Rotation of paddle handle 14 causes drive member 19 to move as indicated by arrow B—B in FIGS. 1 and 3B.

The pivotal connection of linkage member 21 to drive member 19 results in linkage member 21 being moved along line C—C upon actuation of paddle handle 14. This movement is substantially linear and is directed along the length of and behind the base member 16. The connection of linkage member 21 to operating mechanism 26 results in a rotation of operating mechanism 26 as indicated by the arrows D—D in FIGS. 1 and 2. Rotation of operating mechanism 26 therefore results in a movement of first rod 24 and second rod 25. This movement is indicated as arrow E—E concerning first rod 24 and arrow F—F concerning second rod 25.

Figure 4A:
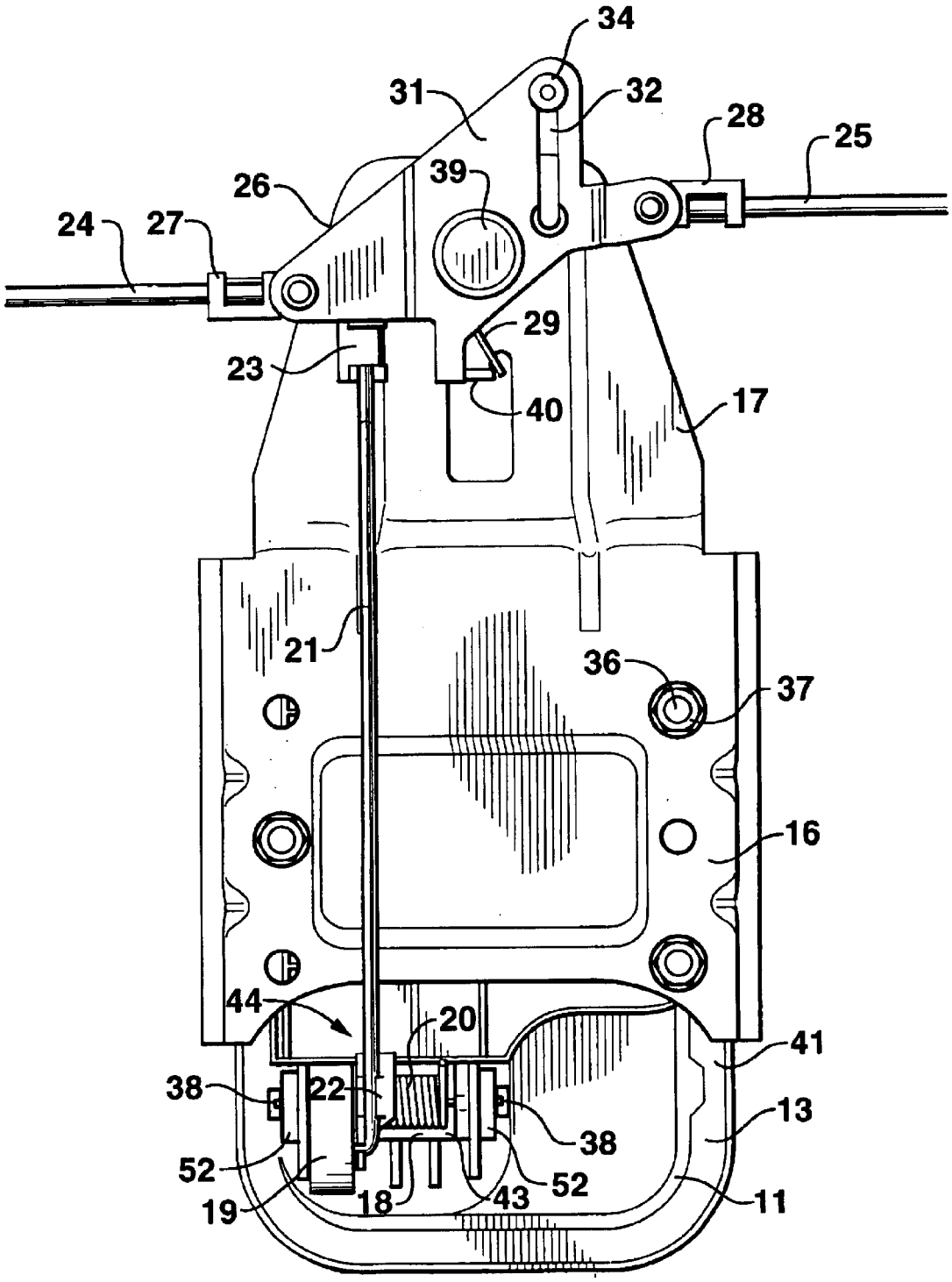
FIG. 4A is a bottom plan view of the offset handle assembly of FIG. 1 showing the operating mechanism in an unoperated condition.
Figure 4B:
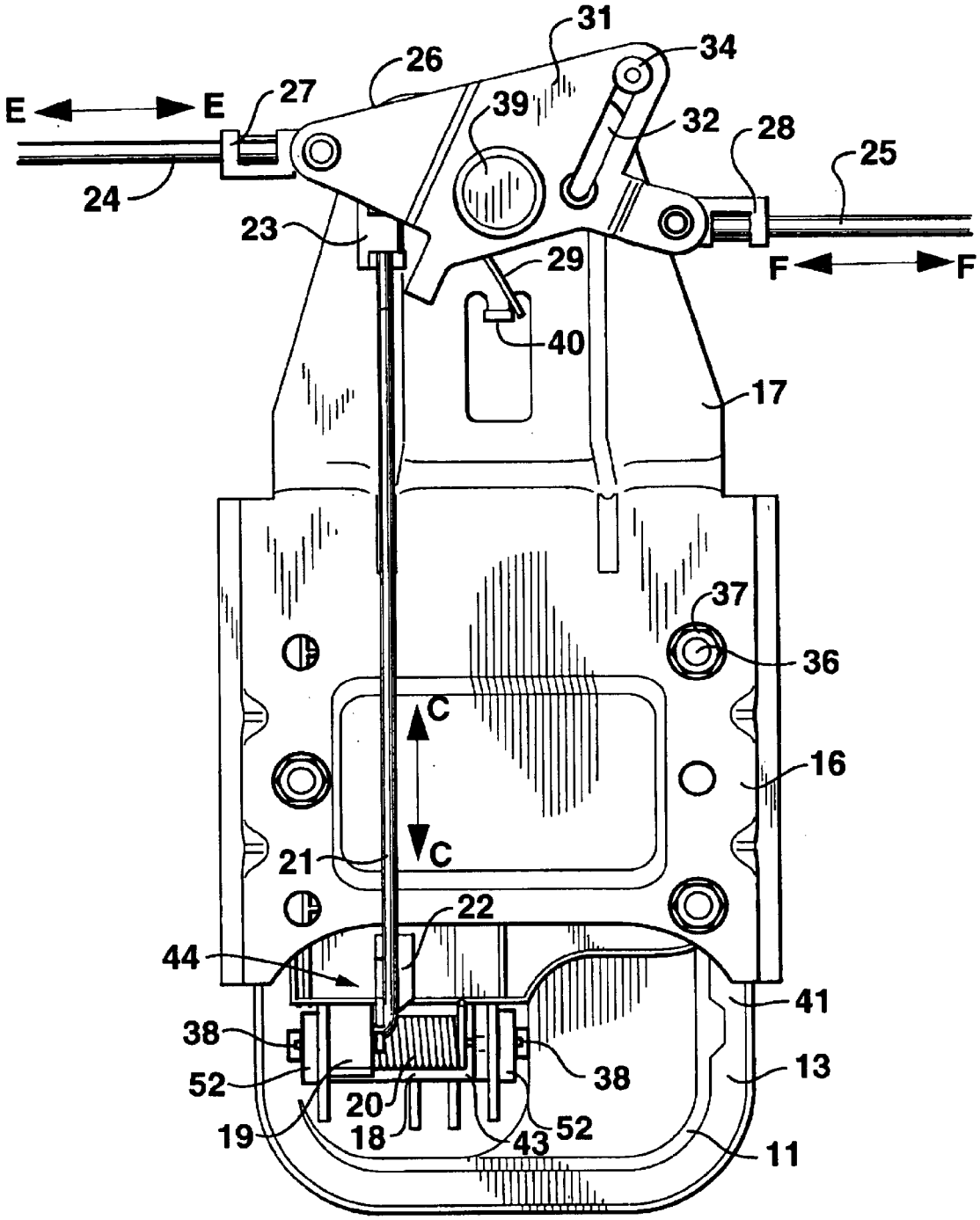
FIG. 4B is a bottom plan view of the offset handle assembly of FIG. 1 showing the operating mechanism in an operated condition.

FIG. 4A shows the offset handle assembly 10 in an unactuated position and FIG. 4B shows the offset handle assembly 10 in an actuated position. Actuation of offset handle assembly 10 can be prevented by a locking mechanism (not shown). Such locking mechanisms are commonly known in the prior art. A typical prior art locking mechanism could be housed within cylindrical lock recess 15. Such a lock would selectively prevent rotation of drive member 19, and consequently prevent unlatching of the door.

As demonstrated by the description of one preferred embodiment of the present invention, the offset handle assembly 10 is a relatively thin, compact unit, moving operating mechanism 26 to the side of tray 11, as opposed to behind tray 11 as in the prior art, and allows for improved space savings. These space savings can result in increased applications for paddle handles, along with improved aerodynamic and economic benefits.

An alternative lockable embodiment of an offset handle assembly 10 is illustrated in FIGS. 5A through 5D. This embodiment possesses a similar offset mechanism 26 as described above with only minor design modifications, for instance a spacer 54 is present proximate to the first operating member 30. Additionally, the rest of the offset handle assembly 10 is for the most part identical to the previously described embodiment. However, a lock cylinder 46 is shown inserted into the cylindrical lock recess 15 in FIG. 5A. A lock member 48 is incorporated into this design. The lock member 48 has a flange connection end 50 located on one end and connected to a flange 47 at the lock cylinder 46. A lock member connection 53 is on an opposite end, which connects the lock member 48 onto operating mechanism 26. Operation of such a configuration of the offset handle assembly 10 is as described above.

It will be appreciated that various modifications and changes may be made to the above described preferred embodiment of an offset handle assembly for use in a vehicle or structure without departing from the scope of the following claims.

I claim:

1. A paddle handle assembly having an offset operating mechanism, the paddle handle assembly comprising:

a tray defining a recess and having a front side and a back side;

a paddle handle disposed in said recess on the front side of said tray, said paddle handle pivotal with respect to said tray;

a base member extending from the back side of said tray, said base member having a base flange on one end of said base member extending laterally adjacent said recess;

a drive member mounted for pivotal movement with said paddle handle, said drive member having a drive portion disposed on the back side of said tray;

at least one linkage member operatively connected to said drive member, said linkage member disposed proximate to the back side of said tray; and an operating mechanism secured to said base flange and operatively connected to said linkage member, pivoting of said paddle handle relative to said tray causing said operating mechanism to operate by way of said drive member and said linkage member, said operating mechanism including a pin, a first operating mechanism member rotatably mounted to said pin, a second operating mechanism member rotatably mounted to said pin, the second operating mechanism member being pivotable relative to the first operating mechanism member, and an operating mechanism bolt extending through the first and second operating mechanism members for pivoting said first operating mechanism member relative to said second operating mechanism member.

2. The paddle handle assembly of claim 1, further including:

a first spring biasing said paddle handle and said drive member to a first spring biased position; and a second spring biasing said operating mechanism to a second spring biased position.

3. The paddle handle assembly of claim 1, further including:

a first rod pivotally connected to one end of said operating mechanism for connection to a first latch; and a second rod pivotally connected to another end of said operating mechanism for connection to a second latch.

4. The paddle handle assembly of claim 1, wherein said linkage member moves substantially forward and backward in one direction, the paddle handle assembly further including a first rod pivotally connected to one end of said operating mechanism, said first rod moving in a direction substantially perpendicular to that of said linkage member, and a second rod pivotally connected to one end of said operating mechanism, said second rod moving in a direction substantially perpendicular to that of said linkage member.

5. The paddle handle assembly of claim 1, wherein said recess of said tray is located substantially between said operating mechanism and said drive member.

6. The paddle handle assembly of claim 1, wherein said base flange of said base member is disposed laterally offset from said tray and intermediate a first plane defined by the front side of said tray and a second plane defined by the back side of said tray.

7. A paddle handle assembly having an offset operating mechanism, the paddle handle assembly comprising:

a tray defining a recess and having a front side and a back side;

a paddle handle disposed in said recess on the front side of said tray, said paddle handle pivotal with respect to said tray;

a base member extending from the back side of said tray, said base member having a base flange on one end of said base member extending laterally adjacent said recess;

a drive member mounted for pivotal movement with said paddle handle, said drive member having a drive portion disposed on the back side of said tray;

at least one linkage member operatively connected to said drive member, said linkage member disposed proximate to the back side of said tray;

an operating mechanism secured to said base flange and operatively connected to said linkage member, pivoting of said paddle handle relative to said tray causing said operating mechanism to operate by way of said drive member and said linkage member, said recess of said tray being located substantially between said operating mechanism and said drive member;

a first spring biasing said paddle handle and said drive member to a first spring biased position; and a second spring biasing said operating mechanism to a second spring biased position.

8. The paddle handle assembly of claim 7, further including:

a first rod pivotally connected to one end of said operating mechanism for connection to a first latch; and a second rod pivotally connected to another end of said operating mechanism for connection to a second latch.

9. The paddle handle assembly of claim 7, wherein said linkage member moves substantially forward and backward in one direction, the paddle handle assembly further including a first rod pivotally connected to one end of said operating mechanism, said first rod moving in a direction substantially perpendicular to that of said linkage member, and a second rod pivotally connected to one end of said operating mechanism, said second rod moving in a direction substantially perpendicular to that of said linkage member.

10. The paddle handle assembly of claim 7, wherein said base flange of said base member is disposed laterally offset from said tray and intermediate a first plane defined by the front side of said tray and a second plane defined by the back side of said tray.

11. An offset handle assembly comprising:

a tray having a front side and a back side and defining a recess;

a handle pivotal with respect to said tray, said handle being substantially located within the recess and on the front side of said tray;

a mechanical linkage operatively connected to said handle, said mechanical linkage operating when said handle is turned; and an operating mechanism operatively connected to said mechanical linkage, said operating mechanism being disposed on the back side of the tray adjacent the recess so as to be laterally offset from said handle, operation of said mechanical linkage causing said operating mechanism to operate, said operating mechanism including a pin, a first operating mechanism member rotatably mounted to said pin, a second operating mechanism member rotatably mounted to said pin, the second operating mechanism member being pivotable relative to the first operating mechanism member, and an operating mechanism bolt extending through the first and second operating mechanism members for pivoting said first operating mechanism member relative to said second operating mechanism member.

12. The offset handle assembly of claim 11, further including:

a first spring biasing said handle to a first spring biased position; and a second spring biasing said operating mechanism to a second spring biased position.

13. The offset handle assembly of claim 11, further including:

a first rod pivotally connected to one end of said operating arm for connection to a first latch; and a second rod pivotally connected to another end of said operating arm for connection to a second latch.

14. The offset handle assembly of claim 11, wherein said mechanical linkage has a substantially rotational motion and a substantially linear motion, the offset handle assembly further including a first rod pivotally connected to one end of said operating mechanism for connection to a first latch, said first rod moving in a substantially linear motion substantially perpendicular to said substantially linear motion of said mechanical linkage, and a second rod pivotally connected to one end of said operating mechanism for connection to a second latch, said second rod moving in a substantially linear motion substantially perpendicular to said substantially linear motion of said mechanical linkage.

15. The offset handle assembly of claim 11, wherein said mechanical linkage includes a drive member pivotal along with said handle, said drive member having a drive portion disposed on the back side of said tray, and at least one linkage member pivotally connected to said drive member at one end of said linkage member, and said linkage member connected at an opposite end to said operating mechanism to effect rotation of said operating mechanism.

16. The offset handle assembly of claim 11, wherein said mechanical linkage has a drive member operatively connected to and pivotal with said handle, and said recess is located between said operating mechanism and said drive member.

17. An offset handle assembly comprising:

a tray having a front side and a back side and defining a recess;

a handle pivotal with respect to said tray, said handle being substantially located within the recess and on the front side of said tray;

a mechanical linkage operatively connected to said handle, said mechanical linkage operating when said handle is turned;

an operating mechanism operatively connected to said mechanical linkage, said operating mechanism being disposed on the back side of the tray adjacent the recess so as to be laterally offset from the handle, operation of said mechanical linkage causing said operating mechanism to operate, said mechanical linkage having a drive member operatively connected to and pivotal with said handle, said recess being located between said operating mechanism and said drive member;

a first spring biasing said handle to a first spring biased position; and a second spring biasing said operating mechanism to a second spring biased position.

18. The offset handle assembly of claim 17, further including:

a first rod pivotally connected to one end of said operating arm for connection to a first latch; and a second rod pivotally connected to another end of said operating arm for connection to a second latch.

19. The offset handle assembly of claim 17, wherein said mechanical linkage has a substantially rotational motion and a substantially linear motion, the offset handle assembly further including a first rod pivotally connected to one end of said operating mechanism for connection to a first latch, said first rod moving in a substantially linear motion substantially perpendicular to said substantially linear motion of said mechanical linkage, and a second rod pivotally connected to one end of said operating mechanism for connection to a second latch, said second rod moving in a substantially linear motion substantially perpendicular to said substantially linear motion of said mechanical linkage.

20. The offset handle assembly of claim 17, wherein said mechanical linkage includes a drive member pivotal along with said handle, said drive member having a drive portion disposed on the back side of said tray, and at least one linkage member pivotally connected to said drive member at one end of said linkage member, and said linkage member connected at an opposite end to said operating mechanism to effect rotation of said operating mechanism.

* * * * *